United States Patent [19]

Scales

[11] Patent Number: 4,499,664

[45] Date of Patent: Feb. 19, 1985

[54] ARTICULATED MAT REVETMENT ASSEMBLY MACHINE

[75] Inventor: Michael J. Scales, Doraville, Ga.

[73] Assignee: Nicolon Corporation, Norcross, Ga.

[21] Appl. No.: 325,677

[22] Filed: Nov. 30, 1981

[51] Int. Cl.[3] ..... B23P 21/00; B23Q 15/00

[52] U.S. Cl. ..... 29/714; 29/241; 29/433; 29/809; 29/824; 198/601; 404/35

[58] Field of Search ..... 29/433, 822, 241, 809, 29/707, 714; 405/20; 404/35, 41, 73; 198/601

[56] References Cited

U.S. PATENT DOCUMENTS

| | | | |
|---|---|---|---|
| 1,306,337 | 6/1919 | Hayden | 29/241 |
| 1,610,633 | 12/1926 | Swanson | 29/241 |
| 1,996,566 | 4/1935 | Boerger | 29/241 X |
| 2,154,855 | 4/1939 | Lear | 29/241 X |
| 2,410,140 | 10/1946 | Young | 29/241 X |
| 2,517,370 | 8/1950 | Young | 29/809 X |
| 2,811,204 | 10/1957 | Kritzer | 29/241 X |
| 2,958,938 | 11/1960 | Nicklasson et al. | 29/241 X |
| 3,004,334 | 10/1961 | Hanson | 29/241 X |
| 4,227,829 | 10/1980 | Landry, Jr. | 404/35 X |

OTHER PUBLICATIONS

Matthews Type C762 Transveyer Catalog Sheet, p. 10B-5.

*Primary Examiner*—Charlie T. Moon
*Attorney, Agent, or Firm*—Kilpatrick & Cody

[57] ABSTRACT

A machine and method for assembling cables and precast grids or blocks into articulated erosion control revetment mats which utilizes a transfer roller conveyor oriented at right angles to a mat receiving belt or roller conveyor and communicating with the mat receiving conveyor by means of a right angle transfer table, together with a hydraulical powered push bar. One embodiment utilizes a belt-type mat receiving conveyor and an automatic push bar position sensing mechanism to activate the mat receiving conveyor and stop the mat and push bar at the proper position and return the push bar after it reaches its extreme of travel. A second embodiment of the invention is designed to be easily transported and assembled at a construction site and to have low power consumption requirements. A cable handling rake utilized with the machine and method is also disclosed.

12 Claims, 13 Drawing Figures

ARTICULATED MAT REVETMENT ASSEMBLY MACHINE

BACKGROUND OF THE INVENTION

This invention relates to a method and machine for assembling cables and pre-cast grids or blocks into articulated erosion control revetment mats or mattresses by arranging such blocks or grids in abutting relationship interconnected by the cables.

The present invention is adapted to be utilized in assembling or manufacturing articulated mat revetment consisting of grids of concrete or other suitable material cast or otherwise provided with one or more tunnels or holes passing horizontally through such grids. The grids are placed in a side by side or staggered abutting relationship, and cables pass through the grids to interconnect them into a mattress or mat. Although such mats may be assembled in situ at the location to be protected by revetment, such assembly is frequently difficult or impossible, such as in installations where all or a portion of the mat will be under water, and it is frequently undesirable for other reasons, such as the unavailability of labor at the site where revetment is to be installed or because of adverse onsite working conditions. Accordingly, such articulated mats are frequently produced adjacent to the installation site and then installed or are produced at a manufacturing location removed from the site where they are to be utilized and are transported to that site. Installation of a mat not assembled in situ is typically accomplished by lifting the mat by one or both ends of cables running therethrough and lowering the mat into place.

Examples of articulated revetment mats which may advantageously be manufactured in accordance with the present invention are disclosed in U.S. patent application Ser. No. 201,569 for "Revetment Grids and Mats" filed by John M. Scales Oct. 28, 1980, now U.S. Pat. No. 4,370,075, issued Jan. 25, 1983, which is particularly well suited for manufacture in accordance with the method and structure of the present invention; U.S. Pat. No. 4,227,829, for "Soil Erosion Prevention Blocks" issued Oct. 14, 1980, to Kossuth J. Landry; and Canadian Pat. No. 957,169, for "Covering Structure for Dams, Dikes and Other Hydrotechnical Constructions" issued Nov. 5, 1974, to E.A.H. Naue KG.

In the prior art practice, assembly of articulated revetment mats has been accomplished by placing grids to be assembled into a mat side by side or end to end on the ground or another supporting structure, and feeding or lacing cables through the colinear tunnels in such grids. Subassemblies of the mat may also first be produced, particularly in producing revetment having cables running in two directions through the mat and even rows and courses of grids, such as the Landry U.S. Pat. No. 4,227,829. For instance, a row of grids can be assembled on one or more cables, sometimes utilizing a conventional roller conveyor to support the grids during such assembly. Then, several rows of grids previously strung on cables can be laid side by side so that cables can be run at right angles to the first set of cables through the courses consisting of grids side by side in adjacent rows. This method of assembly is difficult and labor intensive because it requires a substantial amount grid handling and lifting and because it is difficult to accurately align grids in adjacent rows in order to feed cables through the appropriate holes or tunnels.

SUMMARY OF THE INVENTION

The assembly machines and method of the present invention utilize a transfer roller conveyor oriented at right angles to a mat receiving belt or roller conveyor and communicating with the mat receiving conveyor by means of a right angle transfer table, together with a hydraulically powered grid push bar. In the embodiment utilizing a belt-type mat receiving conveyor, there is an automatic push bar position sensing mechanism to activate the mat receiving conveyor and stop the belt and push bar at the proper position and return the push bar after it reaches its extreme of travel. The present invention facilitates grid handling and cable lacing and permits rapid and economical manufacture of revetment mats.

Unlike the prior art practice, which essentially consists of threading or feeding cables through previously positioned stationary grids, the present invention threads grids onto previously positioned, essentially stationary cables which run lengthwise of the mat. The unexpected achievement of the present invention in simultaneously threading entire courses of grids onto the relatively non-rigid cables results, in part, from the exact positioning of grids accomplished by the method and structure of the present invention and discovery that there is apparently less friction between the cables and the grids of each successive course of grids than the friction between the cables and the previously threaded grids and the assembly machine structures on which the cables rest. Such exact positioning also facilitates passing cable side to side through mats where that is desired or required.

The structure of the present invention comprises generally a transfer roller conveyor having a back stop along one side of the conveyor and communicating with a transfer table having a positioning stop at its end away from the transfer conveyor. The transfer table communicates at a right angle to the transfer conveyor with a mat receiving belt or roller conveyor structure, and a power-driven push bar is positioned to sweep across the transfer table toward the mat receiving conveyor.

The transfer table mechanism is a pneumatically lifted rack of "skate" wheels oriented to support and permit movement of grids colinear with the direction grids are moveable on the transfer conveyor when the skate wheels are lifted to project between roller bars oriented transverse to the transfer conveyor rollers. Such roller bars support and permit movement of grids at right angles to the transfer conveyor when the skate wheels are not lifted.

During typical operation, a number of grids equivalent to the number of grids in the width of the mat to be produced (a "course" of grids) is loaded onto the transfer roller conveyor and aligned evenly against the back stop on the transfer conveyor. By varying the number of grids in succeeding courses, it is possible to produce mats having a triangular or other nonrectangular shape. While the transfer table mechanism is situated to permit movement colinear with the roller conveyor, such grids are then pushed from the transfer conveyor onto the transfer table until stopped by the positioning stop at its far end. The skate wheel rack of the transfer table is then pneumatically dropped, permitting the grids to rest on the transfer table rollers oriented for movement of grids colinear with the mat receiving belt conveyor or roller conveyor structure onto which the mat is assembled. The ends of cables previously cut to the length required for the mat being constructed and laid out along the length of the mat receiving conveyor in approximately the position they will occupy when the mat is completed are threaded into the cable tunnels running through the grids in alignment with the cables. The hydraulically powered push bar is then activated, and the bar sweeps across the transfer table and toward the mat receiving conveyor moving the grids onto the mat receiving belt or roller conveyor and further onto the cables. In the belt conveyor embodiment of the invention, as the center of gravity of the course of grids moves beyond the last roller of the transfer table, the grids tilt onto belt, which is simultaneously actuated to move forward in synchronization with the push bar. Both push bar and belt conveyor stop at the position where the trailing edge of the grids is slightly beyond the point of their first contact with the belt. When a mat receiving roller conveyor is utilized rather than a belt conveyor, the push bar moves the course of blocks onto the roller conveyor and each such course pushes the preceeding courses forward.

The push bar then automatically returns to its starting position at the front of the transfer table, and the cycle is repeated by loading grids onto the transfer conveyor for a second course, moving them onto the transfer table, threading the cable ends into the second course of blocks and lowering the transfer table skate wheel rack, activating the push bar and pushing the second course of grids onto the belt conveyor abutting the first course.

During assembly of mats in configurations requiring cables transverse to the mat receiving conveyor as well as cables colinear with it, such tranverse cables may be threaded side to side through the grids before or after each course has been moved onto the belt conveyor or at any other convenient time such as after all courses of a mat have been threaded onto the lengthwise oriented cables and have been moved onto the mat receiving conveyor.

After a full mat has been assembled on the mat receiving conveyor, protruding cable ends may be bound into loops by connecting adjacent cable ends, stops may be affixed to the cables if desired to prevent movement of grids along the cables beyond the stops, and the mat may be lifted by such loops directly off of the conveyor or, if the belt conveyor is used, it may be ejected by powered movement of the belt conveyor onto a communicating roller conveyor, where the mat may be removed while assembly of a new mat begins.

It is thus an object of the present invention to provide a machine for assembling cables and concrete grids into articulated revetment mats or matresses of rectangular and other shapes.

It is another object of the present invention to provide a machine to facilitate handling of concrete grids and positioning of such grids for assembly into articulated revetment mats.

It is a further object of the present invention to provide a method of assembling cables and precast concrete grids into articulated revetment mats which facilitates and speeds such assembly, reduces labor expense, and limits damage to grids during assembly while producing high quality mats.

It is yet another object of the present invention to provide a simplified articulated revetment mat assembly machine with relatively low power requirements which may be disassembled into components transportable by conventional transportation means and which may be quickly and easily assembled on site.

Other objects and advantages of the present invention will be apparent from the following description and claims, particularly when read in conjunction with the accompanying drawings.

DETAILED DESCRIPTION OF THE DRAWINGS

Figure 1:
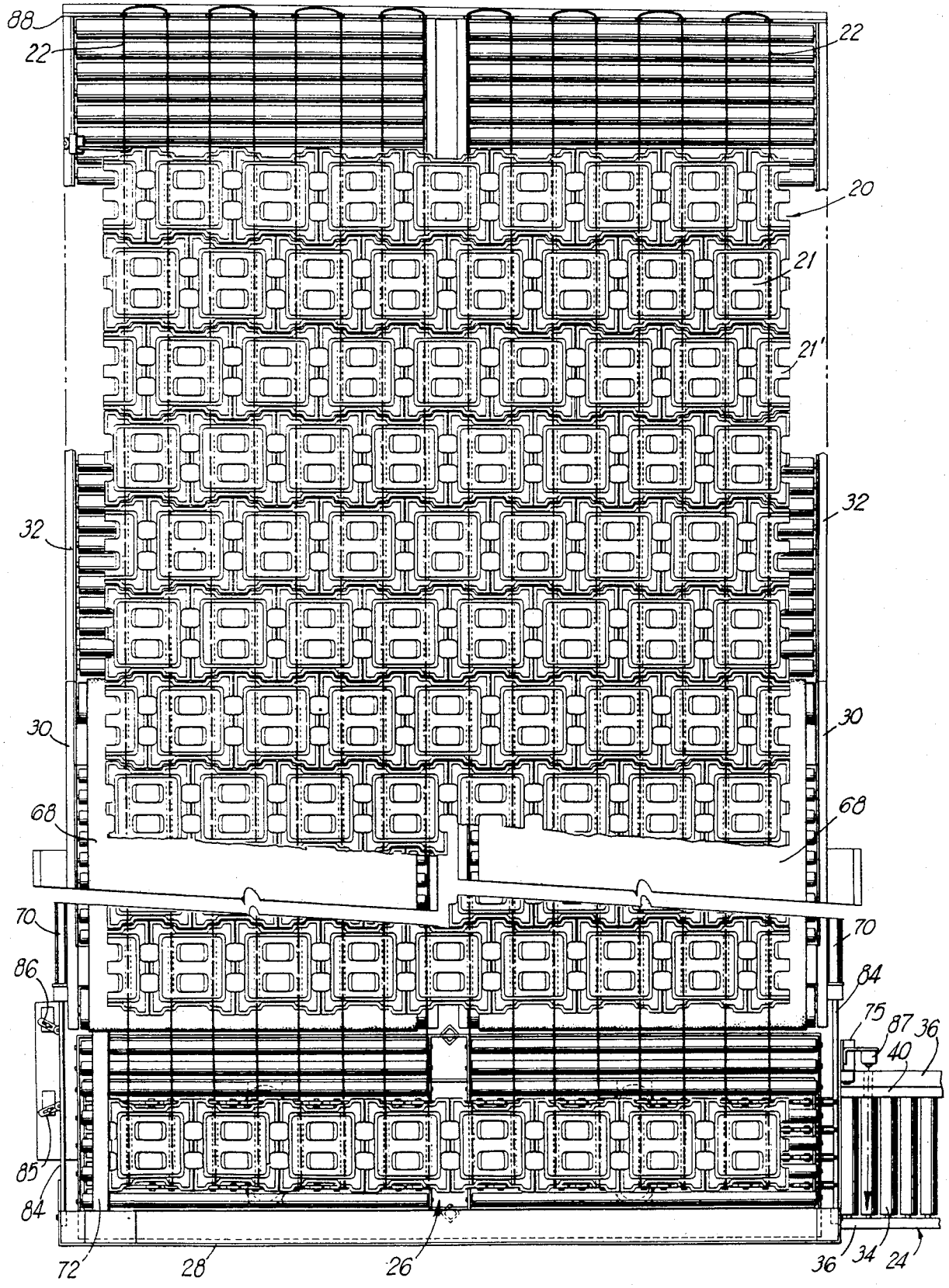
FIG. 1 is a top plan view of the first embodiment of the mat assembly machine of the present invention together with a partially assembled revetment mat showing the belt conveyors broken and only a portion of the transfer roller conveyor.
Figure 2:
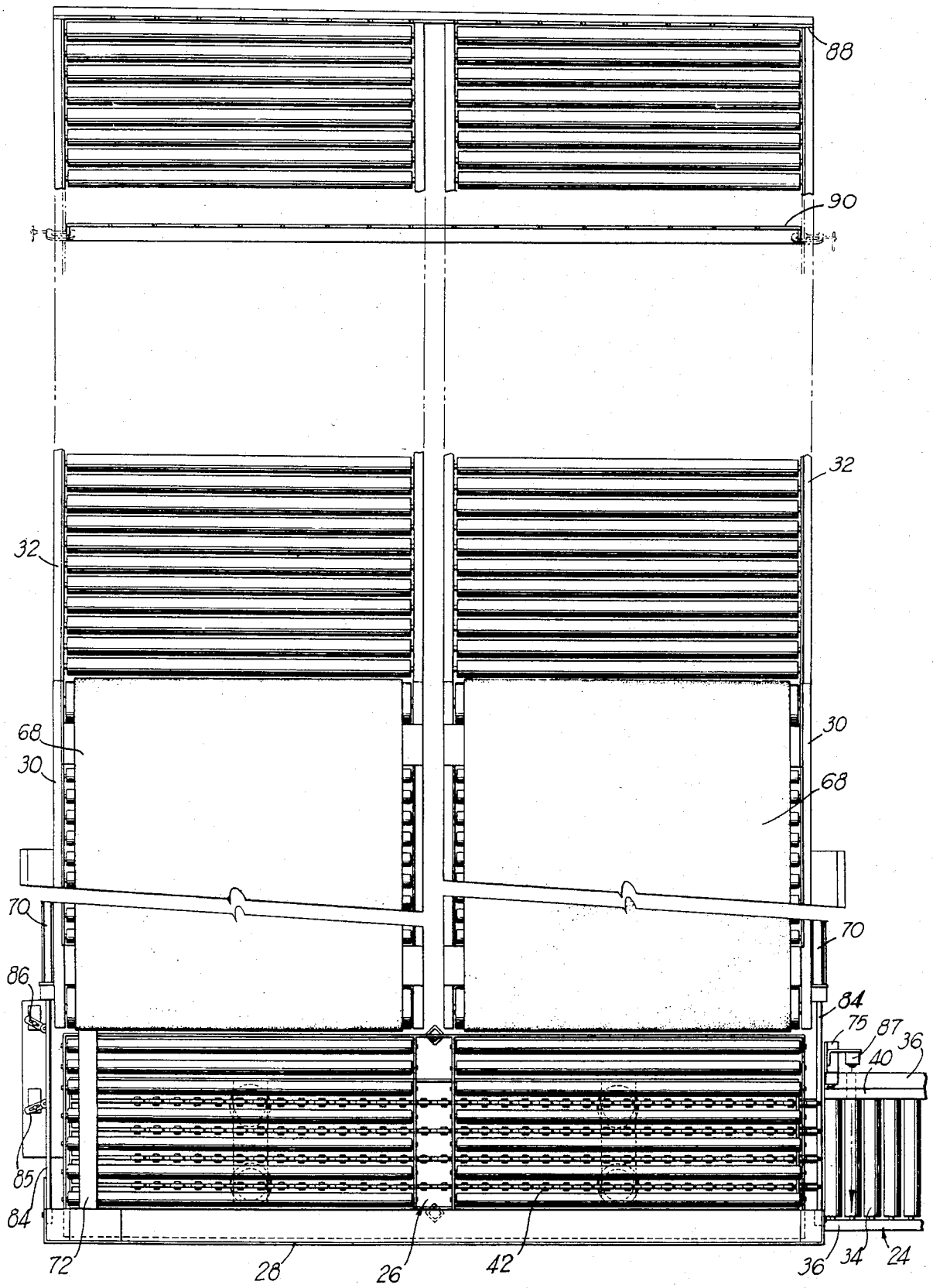
FIG. 2 is a top plan view of the mat assembly machine shown in FIG. 1 without any blocks or cables shown thereon.

The first embodiment of the mat assembly machine of the present invention is shown together with a partially assembled mat 20 and cables 22 in FIG. 1 and without such mat or cables in FIG. 2. It comprises generally a transfer roller conveyor 24, a right angle transfer table 26, a push bar 28, a pair of hydraulically powered belt conveyors 30 and a pair of mat receiving roller conveyors 32. The partially assembled mat 20 shown in FIG. 1, which is merely illustrative of the type of mat which may be manufactured in accordance with the present invention, comprises grids 21 and half-grids 21', which interlock in staggered courses interconnected by parallel cables 22 running only lengthwise of the mat 20.

Figure 3A:
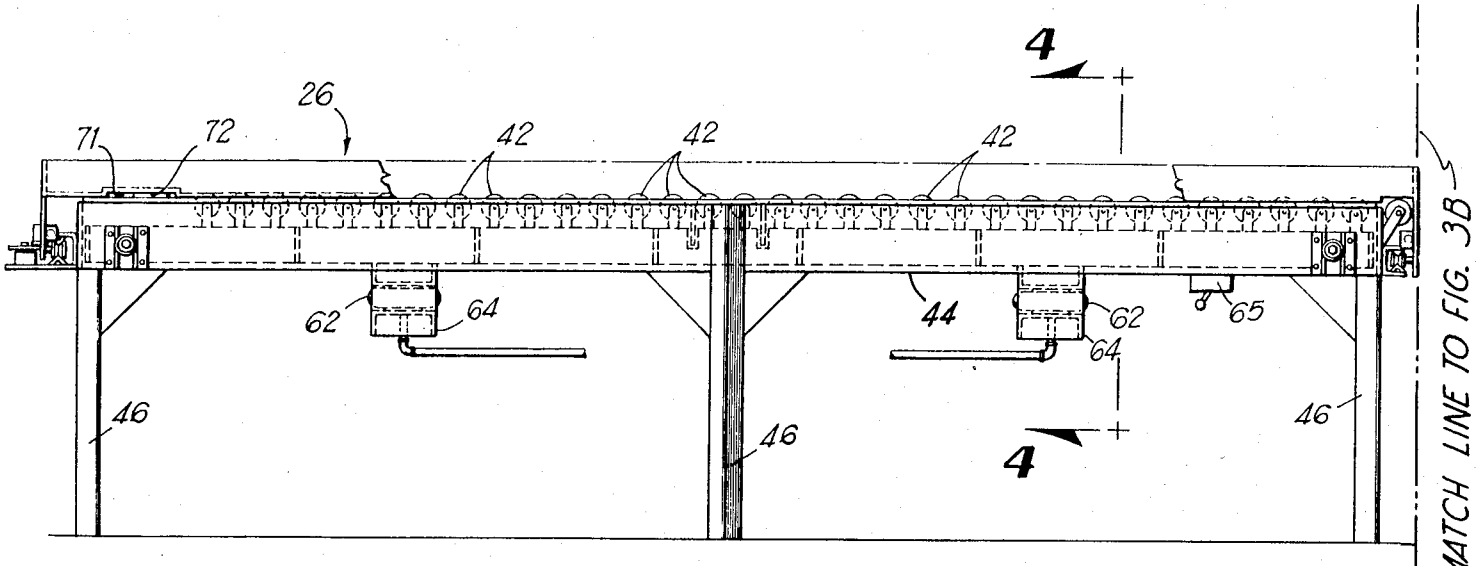
FIGS. 3A and 3B are a side elevational view of the first embodiment of the mat assembly machine shown in FIG. 1 showing, in FIG. 3A, the transfer table and push bar and, in FIG. 3B, the transfer conveyor.
Figure 3B:
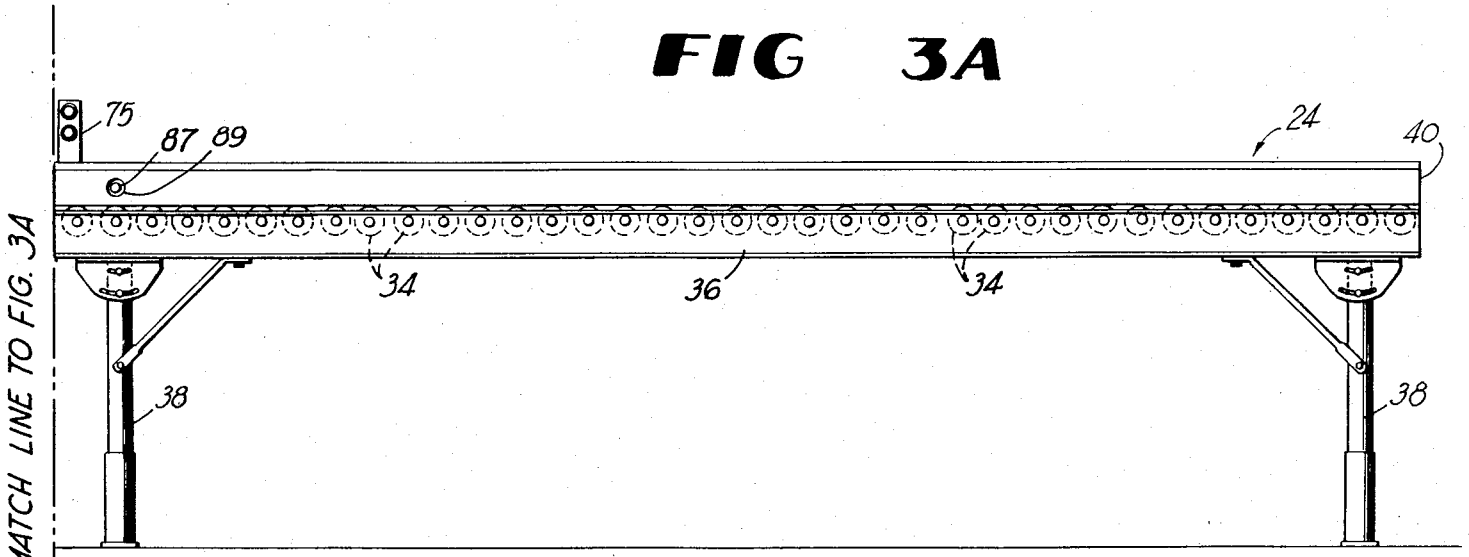

The transfer roller conveyor, as will be appreciated by reference to FIGS. 2 and 3B, is a conventional roller conveyor consisting of a plurality of roller bars 34 mounted side by side on steel channel rails 36 supported by legs 38. As will be appreciated by one skilled in the art, transfer conveyor 24 may also be a powered belt conveyor, a skate wheel conveyor or any other suitable type of conveyor freely permitting movement of loads thereon, and preferably only linear movement. A backstop 40 consisting of a rail, such as a three by five inch steel channel, is positioned along one side of the transfer conveyor 24 adjacent to the ends of roller bars 34. Backstop 40 may be positioned on either side of conveyor 24, but location on the back of conveyor 24 (i.e. the same side as the mat receiving belt conveyor 30) will be more convenient if loading of transfer conveyor 24 is being done from the side of conveyor 24 opposite belt conveyor 30.

The left end of transfer conveyor 24 is attached to the right end of right angle transfer table 26 in horizontal alignment with the skate wheels 42 of transfer table 26 so that grids 21 can be moved from conveyor 24 on to skate wheels 42 when they are positioned for such movement as described below.

Referring to FIGS. 3A and 5–7, transfer table 26 comprises a fixed rectangular frame 44 constructed of flat steel stock and mounted on legs 46. Conveyor roller bars 48 are mounted in the frame 44 at right angles to the direction grids 21 so that they may move on transfer conveyor 24 such that the tops of such rollers 48 are slightly below the tops of rollers 34 in transfer conveyor 24. A movable rectangular rack 50 for wheels 42 also constructed of flat steel stock is mounted below and within the frame 44, and a number of skate wheels 42 sufficient to support a course of grids 21 are mounted on the wheel rack 50 within spaces between roller bars 48 to rotate so as to permit movement of grids 21 resting on them in the same directions grids 21 may move on the rollers 34 of the transfer conveyor 24.

Figure 4:
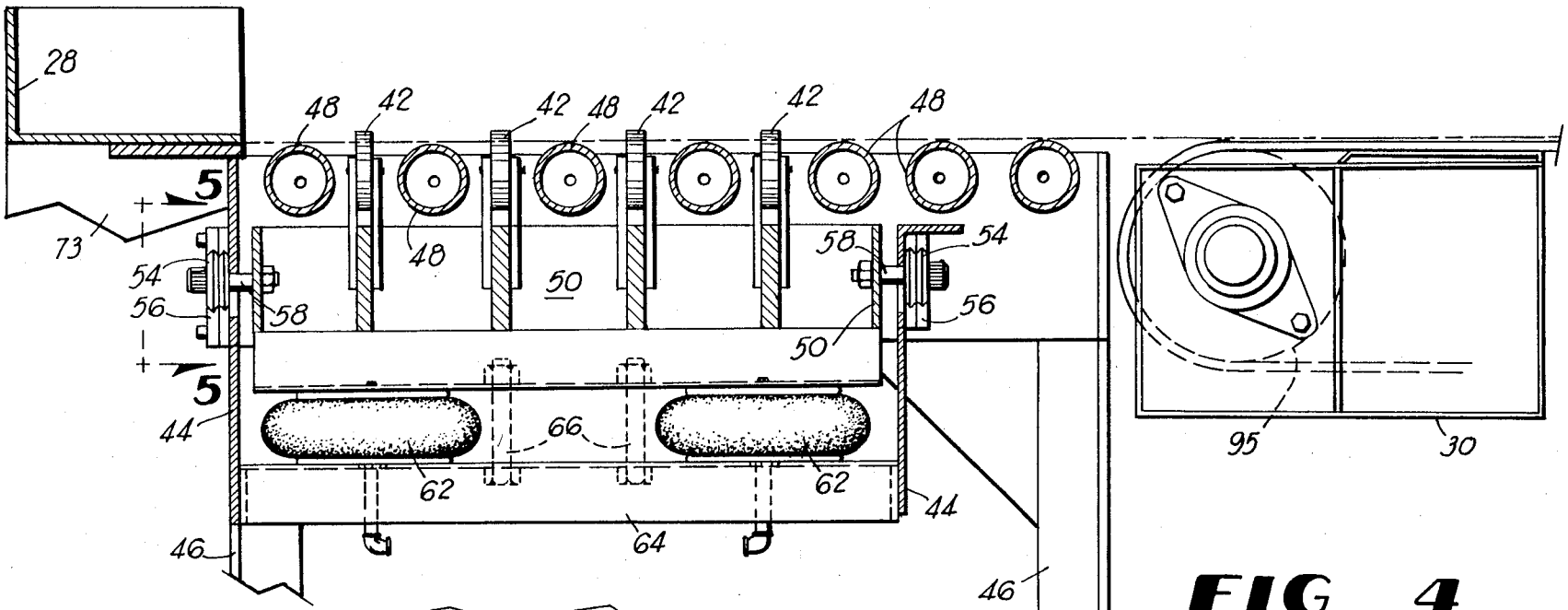
FIG. 4 is a side elevational detail view of the transfer table portion of first embodiment of the present invention taken along line 4—4 in FIG. 3A.
Figure 6:
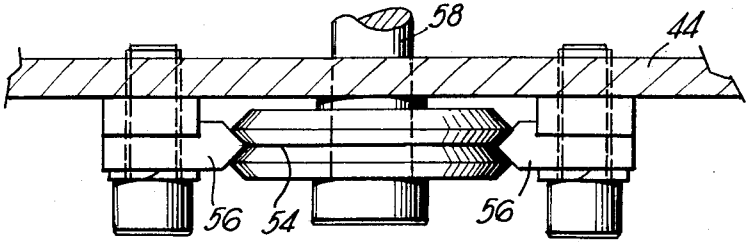
FIG. 6 is a top plan view of the knife-edge and "V" roller structure of the transfer table taken along line 6—6 in FIG. 5.
Figure 5:
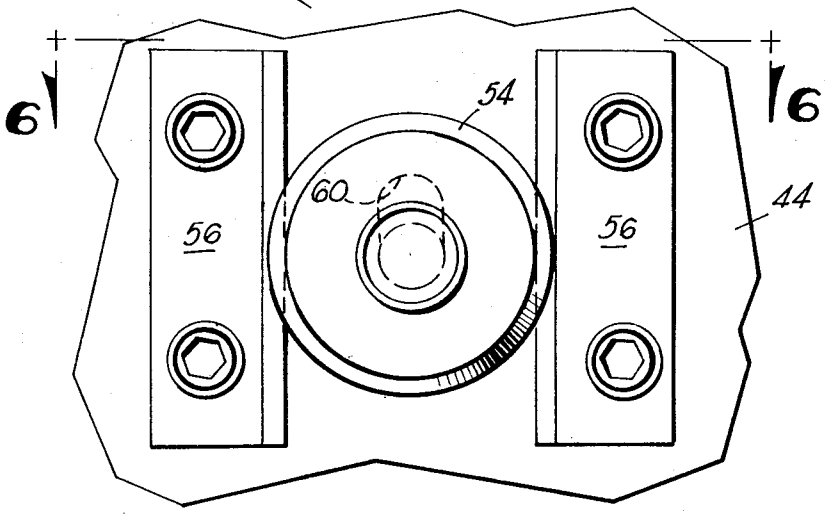
FIG. 5 is a detail view of one of the knife-edge and "V" roller structures of the transfer table taken along line 5—5 in FIG. 4.

Referring particularly to FIGS. 4, 5 and 6, the wheel rack 50 is movable vertically on "V" rollers 54 journaled in vertical knife edges 56 mounted on frame 44. The "V" rollers 54 are mounted on axle bolts 58 affixed near the four corners of wheel rack 50 and extending through oval slots 60 (visible in FIG. 5) in the sides of frame 44. Slots 60 are oriented with their greater dimension vertically so that axle bolts 58 may freely move up and down in slots 60. Each "V" roller 54 is captured by two vertical, parallel knife edges 56 bolted to the frame 44 and positioned to capture the roller 54 and permit vertical movement of the roller 54, thereby permitting limited vertical travel of wheel rack 50 while preventing lateral movement of rack 50.

Wheel rack 50 rests on air stroke actuators 62 shown in FIGS. 3A and 4 which in turn rest on supports 64 comprising horizontal channels rigidly connected to frame 44 in any convenient manner. Air stroke actuators 62, which may be commercially available actuators typically used as shock absorbers on vehicles, are controlled by a lever operated air control 65 mounted in any convenient location, such as on frame 44, as shown in FIG. 3A. Wheel rack 50 thus may travel upward when lifted by inflating air stroke actuators 62. Such upward travel is limited by limiting bolts 66 shown in FIG. 4 which communicate between wheel rack 50 and support 64. Limiting bolts 66 may be adjusted to position the top of wheels 42 even with the top of rollers 34 in transfer conveyor 24 when wheels 42 and wheel rack 50 are lifted by air stroke actuators 62. Deflation of air stroke actuators 62 lowers wheel rack 50 and the tops of wheels 42 below the tops of roller bars 48 of the transfer table 26. Total vertical travel of wheel rack 50 and wheels 42 is typically on the order of three-eighths of an inch (ten millimeters).

Transfer table 26 is rigidly connected to two side-by-side belt conveyors 30 having belts 68 and being positioned for movement of loads colinear with movement on roller bars 48 of transfer table 26. The tops of conveyor belts 68 are located slightly below (such as approximately one-fourth inch or six millimeters) the level of the tops of roller bars 48. A single belt conveyor could also be used, but two commercially available belt conveyors conveniently provide a total mat receiving conveyor width on the order of eight (8) feet (2.4 meters), which is a typical mat width.

Belt conveyors 30 are powered by conventional hydraulic gear motors (not shown) coupled to the belts 68 through gear reducers and intermediate belt drives. The hydraulic gear motors are synchronized by use of temperature compensating flow control valves (not shown) so that the belts 68 will move in synchronization.

Utilization of powered belt conveyors 30 provides intermittent forward movement of all grids which have been threaded onto the cables as push bar 28 advances each successive course of grids 21 off of transfer table 26. This reduces the power requirements of hydraulic cylinders 70, since push bar 28 is (as is described below) required to move only one course of grids 21 rather than the entire previously assembled portion of mat 20 with the addition of each new course of grids 21. Such belt conveyors 30 also provide for ejection of completed mats 20 onto roller conveyors 32, thereby clearing the belt conveyors 30 to permit continued mat assembly while the completed mat 20 is being removed from roller conveyors 32, thus speeding mat production. The speed at which mats 20 are ejected onto roller conveyors 32 may be controlled by a hand operated bypass valve (not shown) in conjunction with a separate set of temperature compensated flow control valves (also not shown) which an operator may use to override the above mentioned belt conveyor hydraulic motors controls normally synchronized with the control circuitry for push bar 28.

The hydraulic motors for belt conveyors 30 and the hydraulic cylinders 70 which activate push bar 28 may be activated by air-logic button controls 75 in series which may be located at any position convenient to the operator, such as the position shown in FIGS. 1, 2 and 3B near the connection of transfer conveyor 24 and transfer table 26.

Figure 7:
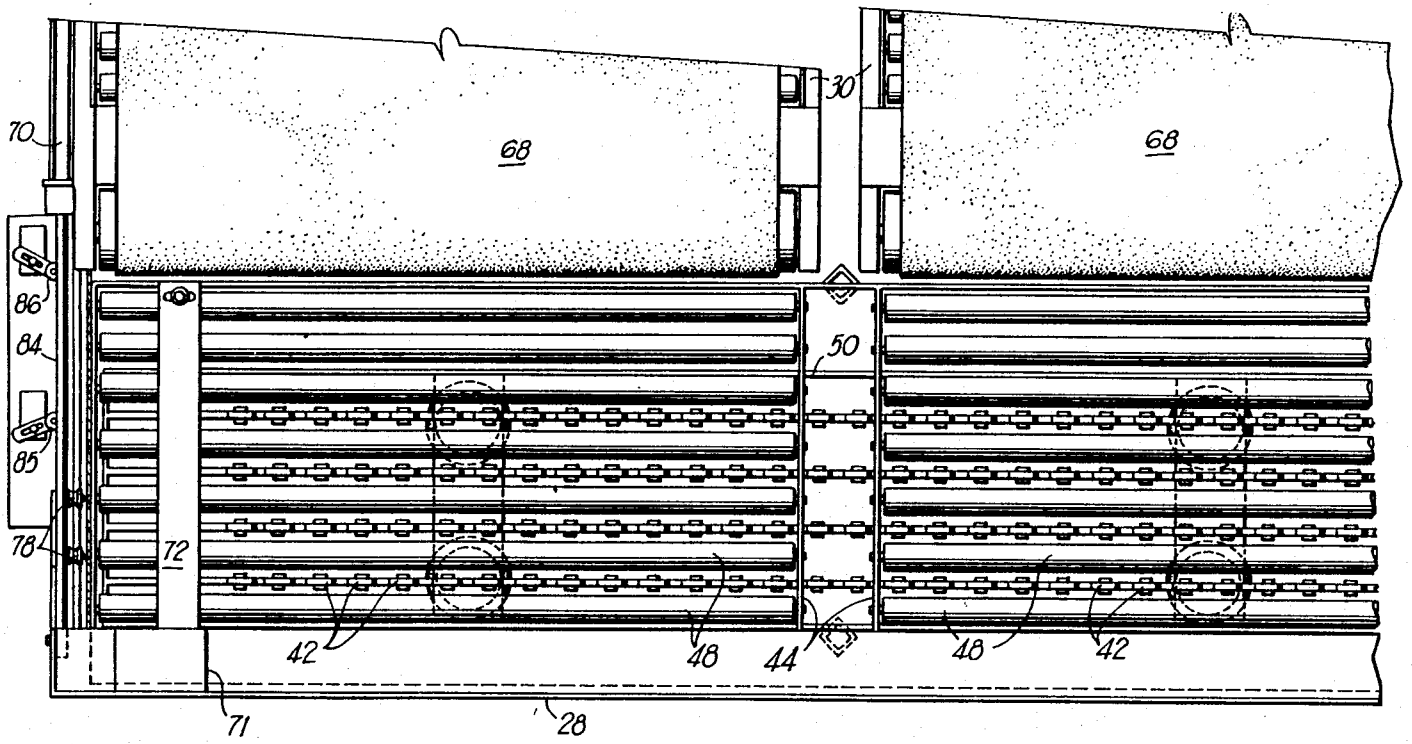
FIG. 7 is a detail top plan view of a portion of the transfer table and belt conveyors of the embodiment of the present invention shown in FIG. 1.
Figure 8:
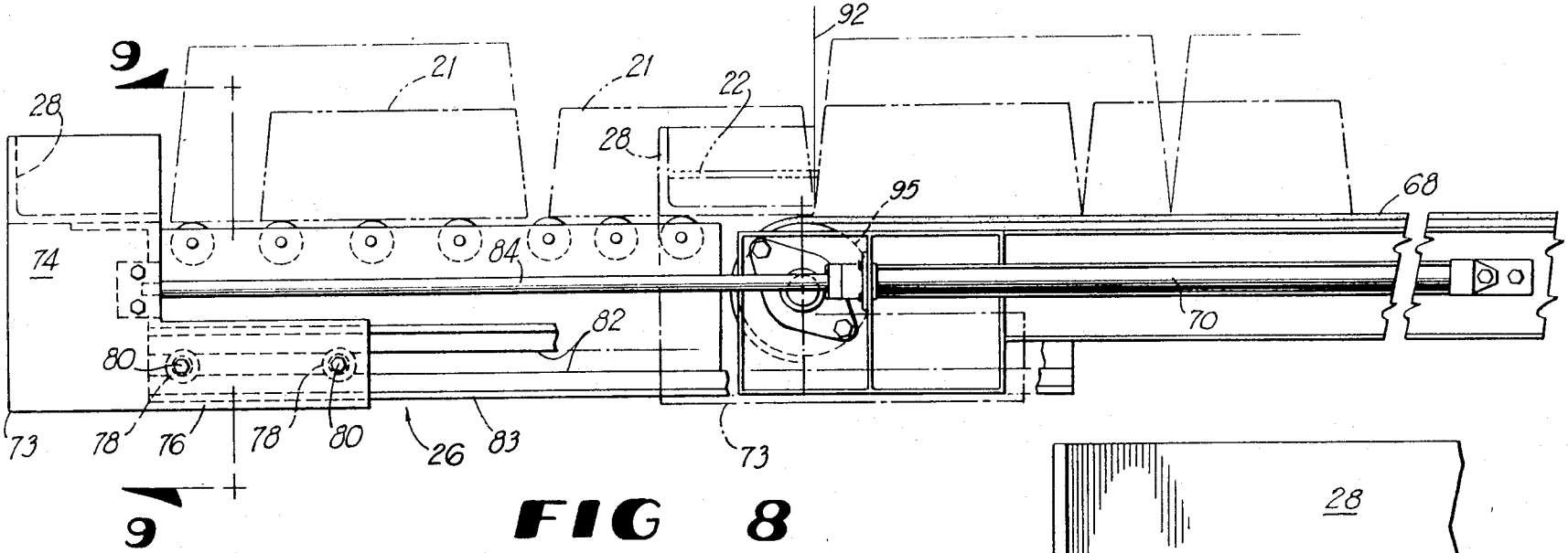
FIG. 8 is a simplified side elevational view of a portion of the transfer table, a portion of the belt conveyor, and one of the hydraulic cylinders of the embodiment of the present invention shown in FIG. 1 with the positions of two sizes of revetment grids and the extreme position of travel of the push bar indicated by broken lines.
Figure 9:
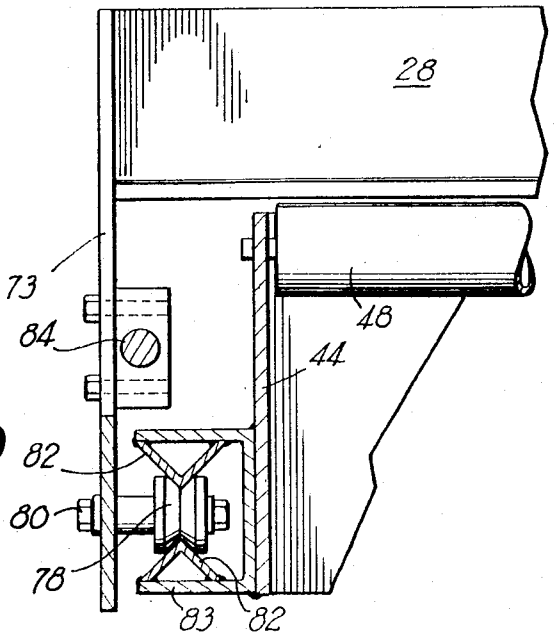
FIG. 9 is an elevational detail view of the push bar and the "V" roller and track structure taken along line 9—9 of FIG. 8.

The push bar 28 is mounted on transfer table 26 as shown in FIGS. 7, 8 and 9 and is actuated to sweep across transfer table 26 and toward belt conveyors 30 by two hydraulic cylinders 70 mounted on each outer side of belt conveyors 30. Push bar 28 may be a section of right angle steel as long as the width of transfer table 26 with a cutout 71 ( shown in FIGS. 3A and 7) so that bar 28 will clear positioning end stop 72. Stop 72 may be a horizontal steel plate bolted to the left end of transfer table 26 just above and at a right angle to roller bars 48. As shown in FIG. 8, push bar arms 73, which may be L-shaped steel plates, support the push bar 28. The upper end 74 of one push bar arm 73 is bolted, welded or otherwise attached to each end of push bar 28, and the lower, horizontal segment 76 of one push bar arm 73 extends along each end of transfer table 26 and an adjacent portion of belt conveyors 30. The horizontal segment 76 of each arm 73 carries two "V" rollers 78 mounted an axle bolts 80 on the inner side of arm segment 76 between arm segment 76 and the ends of transfer table 26. The "V" rollers 78 are captured by horizontal tracks 82, which may be sections of angle iron welded on the opposite inner walls of a steel channel 83 so that an upright "V" cross-section depends from the upper horizontal segment of channel 83 and opposes an inverted "V" cross section resting on the lower horizontal segment of channel 83. Channel 83 is welded or otherwise fastened to the end of transfer table 26.

One end of rod 84 of each hydraulic cylinder 70 connects to approximately the middle of upper segment 74 of arm 73, and hydraulic cylinder 70 is mounted, as stated above, on belt conveyor 30 to move push bar 28 across transfer table 26.

Activation of hydraulic cylinders 70 causes push bar 28 to sweep forward across transfer table 26. An advancing portion of push bar 28 contacts a first microswitch 85 shown in FIGS. 1, 2 and 7 which may be mounted in any convenient location on the transfer table such that it will be activated as the leading edge of the course of blocks 21 being advanced reaches belts 68 of belt conveyors 30. Actuation of first microswitch 85 activates the hydraulic motors for belt conveyors 30, causing belts 68 to begin moving when the leading edge of the course of grid 21 reaches the position indicated by line 92 in FIG. 8 and the grids 21 tilt onto belts 68 and belts 68 advance in synchronization with push bar 28 and at the same speed. Line 92 in approximately one-half inch (13 millimeters) forward of the centerline of conveyor 30 head pulley 95. The grids 21 tilt onto belts 68 as soon as the center of gravity of grids 21 advances beyond the last roller 48 of transfer table 26. Conveyors belts 68, push bar 28, and grids 21 continue to move until push bar 28 or a convenient protruding tab contacts second microswitch 86, which acts through control circuitry to stop the conveyor belts 68 and return push bar 28 to its original position at the front of transfer table 26. Second microswitch 86 is positioned such that it is tripped when the advancing course of grids 21 has moved fully onto belts 68. The microswitches 85 and 86 can be located as appropriate to accommodate various grid lengths, and belt and push bar speeds can be adjusted to modify the assembly speed.

As will be appreciated by reference to FIGS. 8 and 9, the above-described push bar arm 73, "V" roller 78 and tracks 82 structure permits horizontal movement of push bar 28 toward and away from belt conveyor 30 over the top of transfer table 26, and the two "V" rollers 78 and capturing tracks 82 oppose racking and twisting of the push bar structure as it is pulled across transfer table 26 by hydraulic cylinders 70.

Hydraulic cylinders 70 are synchronized by temperature compensating flow control valves (not shown) which equalize the amount of hydraulic fluid flow through the hydraulic pump and reservoir so that cylinders 70 move in synchronization, thereby moving push bar 28 evenly across transfer table 26. Lever operated air control 65, which controls inflation of air stroke actuators 62, is interlocked with the controls for hydraulic cylinders 70 such that cylinders 70 cannot be actuated to sweep push bar 28 across transfer table 26 unless wheel rack 50 and wheels 42 are in their lower position. This prevents inadvertent contact with and damage to wheels 42, which might occur if wheel rack 50 and wheels 42 could be in their lifted position when cylinders 70 are actuated.

Additionally, a photo switch 87 is mounted on transfer table 26 frame 44, as shown in FIGS. 1, 2 and 3B, adjacent to the end of transfer conveyor 24 such that its beam passes through an opening 89 in back-stop 40. Photo switch 87 is actuated when a grid 21 is present at this position, and switch 87 is connected to the control network to prevent actuation of hydraulic cylinders 70 if the presence of a block is sensed by photoswitch 87, because a grid 21 positioned partially on transfer conveyor 24 and partially on transfer table 26 would be broken or might damage the assembly machine if push bar 28 were then allowed to sweep forward.

A cable rake 88 may be attached to the end of conveyors 32 away from transfer table 26. Cable rake 88 may be constructed by machining vertical slots opening to the upper edge of a plate as long as the total width of conveyors 32, which slots are wide enough to accommodate cable 22 and are spaced apart the same distance as cable spacing in the mat 20. Cable rake 88 is used for positioning cables 22 and serves as a gauge when cable 22 ends are being joined into loops after mat assembly. Cable rake 88 also facilitates location of cables on the assembly machine prior to threading grids 21 onto the cables 22. A second, movable cable rake 90 of similar construction (shown in FIG. 2) may be clamped at any convenient location along the roller conveyors 32 or belt conveyors 30 to accommodate a desired different mat 20 length.

Mat assembly in accordance with the present invention is accomplished as follows. The cables 22 which will run longitudinally in the completed mat 20 are cut to length and placed on the assembly machine in approximately the location they will occupy in the completed mat with their ends on the transfer table 26. Location of the cables may be facilitated by looping them over fixed rake 88 or movable rake 90 which has been clamped on the belt conveyors 30 or roller conveyors 32 in a position appropriate to the length of the mat being assembled. A number of grids 21 sufficient to form a full course in the mat 20 to be assembled (typically six or eight grids) is placed on transfer conveyor 24 against backstop 40 so that the course of blocks is aligned evenly.

While the wheel rack 50 of the transfer table 26 is in its raised position, the course of grids 21 is moved onto transfer table 26 until the grid 21 at the end of the course contacts end stop 72 and adjacent grids 21 are touching. The ends of cables 22 are then threaded into the corresponding tunnels 21' in the grids 21 as is shown in FIG. 1. Wheel rack 50 is then lowered to permit movement of grids 21 to belt conveyor 30, and push bar 28 is actuated to sweep across transfer table 26 pushing grids 21 onto conveyor belts 68 and further onto cables 22. As described above, belts 68 are actuated to move forward in synchronization with push bar 28 when grids 21 tilt onto belts 68 of conveyors 30, and belts 68 and push bar 28 automatically stop when the trailing edge of grids 21 reaches the position indicated by line 92 in FIG. 8. Push bar 28 then automatically returns to its stationary position, a second course of grids 21 is loaded onto transfer conveyor 24, and the cycle is repeated until all grids for the mat 20 being constructed have been threaded onto cables 22. Thereafter, cable stops (not shown but sometimes used to prevent grids 21 from sliding more than desired on the cables 22 of completed mats 20) are added and the ends of cables 22 are bound into loops. Mat 20 may then be lifted directly from conveyors 30, or such conveyors may be powered to eject the mat 20 onto communicating roller conveyors 32.

Figure 10:
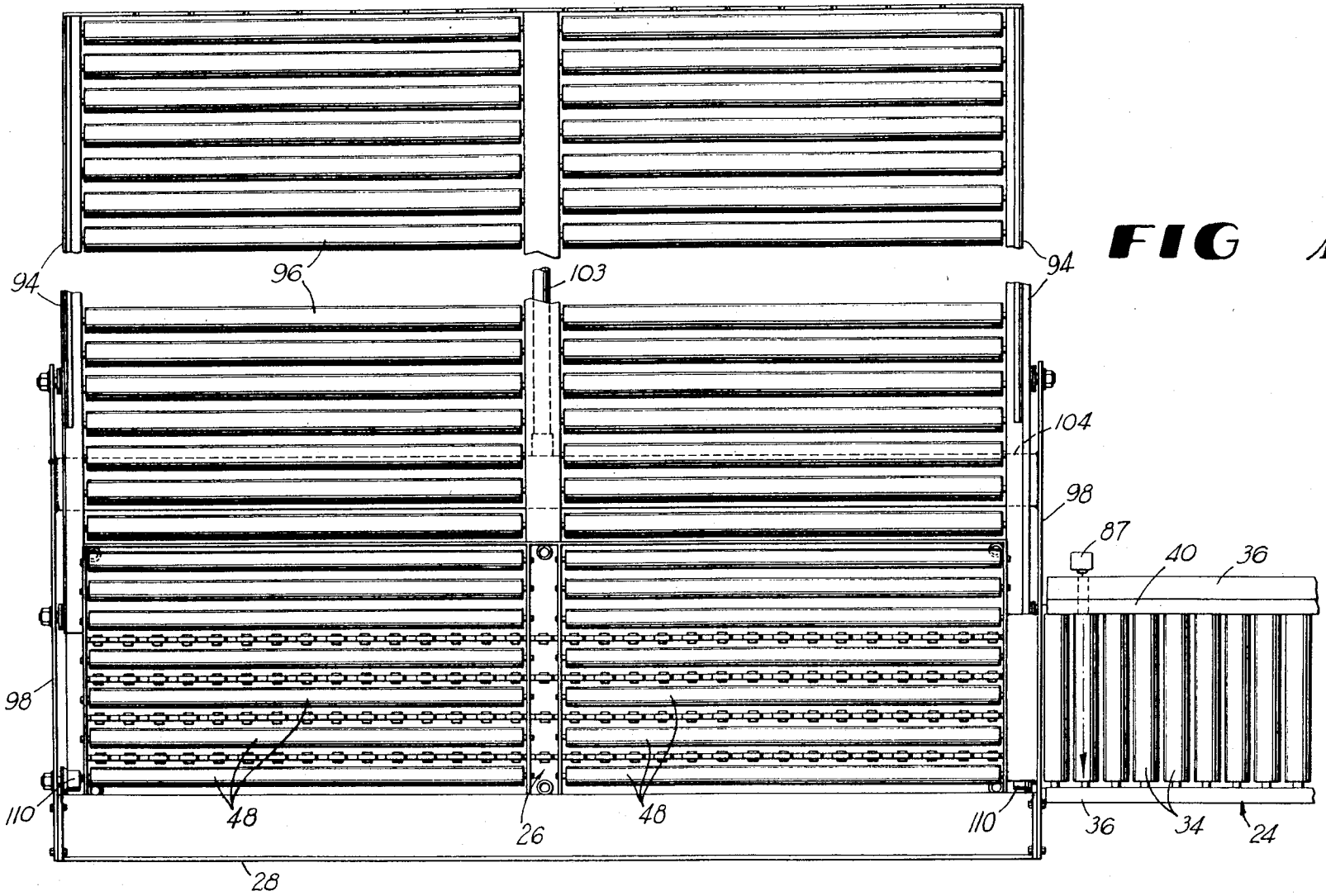
FIG. 10 is a top plan view of a second embodiment of the mat assembly machine of the present invention showing the mat receiving roller conveyor broken and only a portion of the transfer conveyor.
Figure 12:
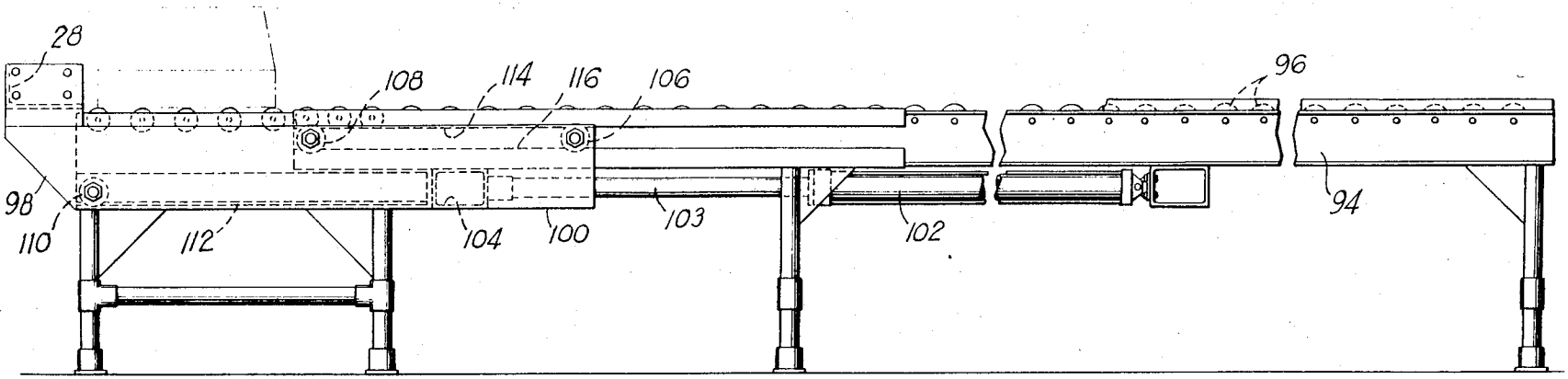
FIG. 12 is a simplified side elevational view of the transfer table and mat receiving roller conveyors of the second embodiment of the present invention shown in FIG. 10 together with the positions of one course of grids on the transfer table indicated in broken lines.
Figure 11:
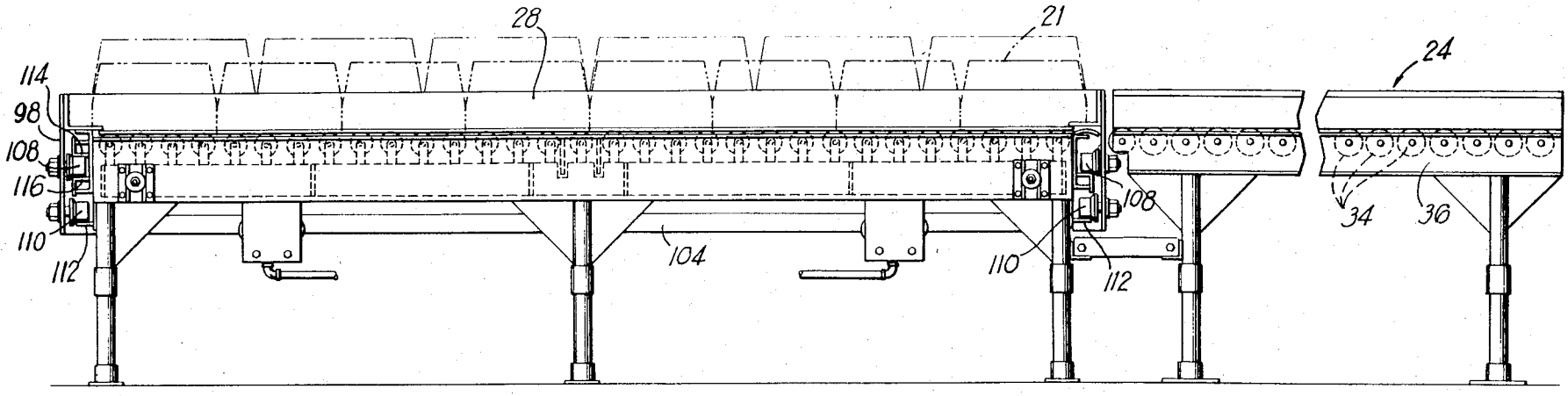
FIG. 11 is a front elevational view of the embodiment of the present invention shown in FIG. 10 with the transfer conveyor shown broken and the positions of two sizes of revetment grids on the transfer table indicated by broken lines.

A second embodiment of the mat assembly machine of the present invention is illustrated in FIGS. 10, 11 and 12. The second embodiment comprises generally a transfer roller conveyor 24 and right angle transfer table 26 substantially identical to those structures in the above-described first embodiment. The second embodiment also includes a push bar 28 similar to the push bar 28 of the first embodiment, but the transfer table 26 connects to a pair of mat receiving roller conveyors 94 disposed side by side and having rollers 96 paralleling the rollers 48 of the transfer table 26 rather than to powered belt conveyors as in the first embodiment.

Push bar 28 is mounted at each end on a push bar arm 98, which is an L-shaped steel plate clearly shown in FIG. 12, having a horizontal segment 100 approximately as long as twice the depth of transfer table 26. Push bar 28 is actuated by a single fixed stroke hydraulic cylinder 102 having a cylinder rod 103 attached to the middle of a draw bar 104 which may be a length of rectangular cross-section tubing. The ends of draw bar 104 are attached to the lower edges of horizontal segment 100 of arms 98, and hydraulic cylinder 102 is mounted between and attached to the frames of roller conveyors 94, as may be seen in FIGS. 10 and 12.

Flange rollers 106, 108, and 110, shown in FIGS. 11 and 12, are mounted on each of arms 98 between such arms and the conveyor structures. Roller 106 is mounted near the upper edge of horizontal segment 100 of arm 98 at the end of horizontal segment 100 furthest from push bar 28. Roller 108 is also located at the upper edge of horizontal segment 100 but approximately midway between roller 106 and push bar 28, and roller 110 is located at the lower edge of horzontal segment 100 approximately directly below the leading edge of push bar 28. Roller 110 bears against a horizontal bearing surface 112, which may be formed by welding a horizontal length of flat stock to the end of transfer table 26 to form a horizontal bearing plate. Rollers 106 and 108 are captured between parallel horizontal bearing surfaces 114 and 116, which may be formed by welding horizontal lengths of angle iron to the ends of transfer table 26 and the outer side of conveyors 94.

As will be appreciated by reference to FIGS. 11 and 12, the above-described arrangement of rollers 106, 108 and 110 and bearing surfaces 112, 114 and 116 permits arms 98 and push bar 28 to travel horizontally, sweeping push bar 28 across the top of transfer table 26, while opposing the racking and twisting force exerted by hydraulic cylinder 102 and the mass of blocks 118 or 120 bearing against push bar 28.

The second embodiment of the assembly machine of the present invention illustrated in FIGS. 10, 11 and 12 permits assembly of mats in substantially the same fashion as that accomplished with the first embodiment; however, utilization of roller conveyors 94 rather than belt conveyors permits construction of a mat assembly machine which can accommodate a mat nominally eight (8) feet (2.4 meters) wide, yet the assembly machine may be disassembled for transportation into components small enough for transportation on trucks which, pursuant to regulations, can transport articles no wider than eight feet. Additionally, the components of the second embodiment of the present invention can be assembled and placed in operation more quickly than can components of the first embodiment, because of the absence of the power driven belt conveyors 30 of the first embodiment, which require hydraulic motors and associated structures, and the more compact pump required, which can be mounted under the conveyors 94. Furthermore, the power requirements of the hydraulic cylinder 102 which actuates push bar 28 are substantially less than the power requirements for the belt conveyors 30 utilized in the first embodiment. However, the ability to eject mats from the belt conveyors 30 of the first embodiment onto a connecting roller conveyor to permit assembly of a second mat while the first is being lifted off of such conveyor is sacrificed, but other means of moving the mats may be used.

Although the present invention is described and illustrated with detailed reference to the preferred embodiments, the invention is not intended to be limited to the details of such embodiment but includes numerous modifications and changes thereto while still falling within the intent and spirit hereof.

I claim:

1. A machine for assembling cables and grids into articulated revetment mats comprising:
   - a transfer conveyor having a backstop along one side thereof on which conveyor a course of the grids may be assembled;
   - a transfer table communicating with the transfer conveyor and having an end stop for receiving courses of grids from the transfer conveyor;
   - a mat receiving conveyor structure communicating with the transfer table at a right angle to the transfer conveyor for receiving from the transfer table successive courses of grids;
   - means for transferring grids on the transfer table to the mat receiving conveyor structure; and
   - means associated with the receiving conveyor structure for holding the cables spaced and in alignment with openings in the grids, so that the cables may receive the grids as the grids are transferred from the transfer table.

2. A mat assembly machine according to claim 1 wherein said grid transfering means comprises a push bar journaled in sliding bearings and actuated by at least one hydraulic cylinder to sweep across the transfer table transverse to the transfer conveyor.

3. A mat assembly machine according to claim 1 wherein said mat receiving conveyor structure comprises a roller bar conveyor structure.

4. A mat assembly machine according to claim 1 wherein said mat receiving conveyor structure includes a powered belt conveyor.

5. A mat assembly machine according to claim 4 further comprising a roller bar conveyor communicating with the end of the belt conveyor.

6. A mat assembly machine according to claim 1 further comprising a means for sensing the presence of a grid partly on the transfer conveyor and partly on the transfer table.

7. A mat assembly machine according to claim 1 wherein said transfer table comprises a fixed frame carrying roller bars and a movable rack carrying wheels, which rack may be lifted by air stroke actuators to cause the wheels to project above the rollers.

8. A machine for assembling cables and grids into articulated revetment mats comprising:

a transfer conveyor having a backstop along one side thereof on which conveyor a course of the grids may be assembled;

a transfer table communicating with the transfer conveyor and having an end stop for receiving courses of grids from the transfer conveyor;

a belt conveyor communicating with the transfer table at a right angle to the transfer conveyor for receiving successive courses of grids, said belt conveyor being powered intermittently to advance the top of said belt away from the transfer table;

a mat receiving conveyor communicating with the best conveyor for receiving successive courses of grids from the belt conveyor;

a rake mounted on the mat receiving conveyor to provide spaced cables aligned with openings in the grids so that the cables may extend through the openings and thereby receive the grids; and a push bar actuatable to sweep across the transfer table transverse to the transfer conveyor to push successive courses of grids onto the belt conveyor.

9. A machine for assembling cables and grids into articulated revetment mats comprising:

a transfer conveyor for supporting the grids and positioning a course of the grids for assembly;

a grid receiving conveyor adjacent to the transfer conveyor for receiving successive courses of grids from the transfer conveyor and for supporting cables and the grids as they are assembled into a mat; and a means for transferring a course of the grids from the transfer conveyor to the receiving conveyor and to advance the grids on the cables.

10. A mat assembly machine according to claim 9, further comprising a means for aligning and positioning the cables on the receiving conveyor prior to mat assembly.

11. A mat assembly machine according to claim 9 further comprising a means of ejecting assembled mats from the receiving conveyor onto a finished mat conveyor.

12. A machine for assembling cables and grids into articulated revetment mats comprising:

a transfer roller conveyor having a backstop along one side thereof on which conveyor a course of the grids may be assembled;

a roller bar and skate wheel right angle transfer table connected to one end of the transfer conveyor for receiving courses of grids from the transfer roller conveyor, said table having an end stop;

a belt conveyor structure adjacent to the transfer table at a right angle to the transfer conveyor for receiving successive courses of grids, said belt conveyor being powered to advance the grids away from the transfer table;

a mat receiving roller conveyor structure communicating with the belt conveyor for receiving successive courses of grids from the belt conveyor structure;

a push bar journaled in sliding bearings and powered by at least one hydraulic cylinder to sweep across the transfer table transverse to the transfer conveyor to push successive courses of grids onto the belt conveyor structure;

a means for sensing the position of the push bar as it sweeps across the transfer table; and a rake mountable on the mat receiving conveyor or the belt conveyor and having a plurality of vertical slots to accept the cables to provide spaced cables aligned with openings in the grids so that the cables may extend through the openings and thereby receive the grids.

* * * * *